US010722084B2

(12) United States Patent
Evans

(10) Patent No.: US 10,722,084 B2
(45) Date of Patent: Jul. 28, 2020

(54) PORTABLE TOILET SEAT

(71) Applicant: Richard Donald Evans, Humble, TX (US)

(72) Inventor: Richard Donald Evans, Humble, TX (US)

( * ) Notice: Subject to any disclaimer, the term of this patent is extended or adjusted under 35 U.S.C. 154(b) by 0 days.

(21) Appl. No.: 16/212,018

(22) Filed: Dec. 6, 2018

(65) Prior Publication Data

US 2020/0178739 A1 Jun. 11, 2020

(51) Int. Cl.
*A47K 13/00* (2006.01)
*A47K 13/12* (2006.01)

(52) U.S. Cl.
CPC ..... *A47K 13/005* (2013.01); *A47K 13/12* (2013.01)

(58) Field of Classification Search
CPC ..... A47K 13/005; A47K 13/12
USPC ..... 4/239
See application file for complete search history.

(56) References Cited

U.S. PATENT DOCUMENTS 1,156,629 A 10/1915 Rivera et al.
1,410,427 A * 3/1922 Turnquist ..... A47K 13/06 4/239
1,513,408 A 10/1924 Mccandless et al.
1,693,501 A 11/1928 Casner et al.
2,443,068 A 6/1948 Dahle et al.
2,742,650 A 4/1956 Meade et al.
4,525,880 A 7/1985 Bass
5,005,223 A 4/1991 Greenwood
5,090,063 A 2/1992 Edwards et al.
5,172,431 A 12/1992 Rohde
5,267,355 A 12/1993 Landman
5,461,732 A 10/1995 Reiman
5,852,832 A 12/1998 Voigt et al.
5,974,598 A 11/1999 Granda-Cabrera
6,175,968 B1 1/2001 Schneider
D502,766 S * 3/2005 Nash ..... D23/311
6,968,578 B2 11/2005 Bernsley
6,986,173 B1 1/2006 Hickey
7,523,509 B1 4/2009 Willard
8,677,518 B2 3/2014 Spievey et al.
9,498,097 B2 11/2016 Grant
9,756,994 B2 9/2017 Jackson
D866,732 S * 11/2019 Fu ..... D23/311
2008/0256694 A1 10/2008 Wilbarger
2009/0013455 A1 1/2009 Richardson
2014/0013497 A1 1/2014 Mitchell et al.
2014/0096315 A1 4/2014 Dutchover
2016/0058252 A1 3/2016 Mapes

* cited by examiner

*Primary Examiner* — Huyen D Le
(74) *Attorney, Agent, or Firm* — Dunlap, Bennett & Ludwig PLLC

(57) ABSTRACT

A portable toilet seat for user over pre-existing toilet seats or in lieu of a broken or missing toilet seat is provided. The portable toilet seat provides a chain of arcuate portions pivotably connected in series so as to be adapted to fold among a flat condition, a first folded condition and a second folded condition. The bottom side of each arcuate portions may provide radial fins, each radial fin may provide a concentric slot. The concentric slots share a radial distance from a center of the opening defined by the portable toilet seat in the flat condition so that in such a condition the concentric slots may engage a rim of a toilet basin or bucket, while in the second folded condition the concentric slots securely engage the radial fins of opposing arcuate portions.

7 Claims, 4 Drawing Sheets

PORTABLE TOILET SEAT

BACKGROUND OF THE INVENTION

The present invention relates to bathroom accessories and, more particularly, to a portable toilet seat.

Using a public restroom can be an adventure, in many ways. For one, toilet paper and toilet seat liners may not be available. And even if such paper products are in supply, they typically do not stop moisture and can stick to one's underside when used to line the top of the toilet seat. Furthermore, applying toilet paper to a public toilet seat takes time and sometimes there is no time. Moreover, using toilet paper or toilet seat liners further clogging our overburdened sewer systems. Of course, the toilet may not have a functioning toilet seat to begin with . . . .

As can be seen, there is a need for a portable toilet seat that is convenient to use and prevents unnecessary use of toilet paper and other paper products. The portable toilet seat embodied in the present invention allows a person to have use of a toilet seat if one is not available, and if one is available the present invention enables users to sit on their own personal toilet seat instead of a public toilet seat, providing a sanitary surface to sit on public toilets.

SUMMARY OF THE INVENTION

In one aspect of the present invention, a portable toilet seat includes a chain of arcuate portions pivotably connected in series so as the portable toilet seat is foldable among a flat condition, a first folded condition and a second folded condition.

In another aspect of the present invention, the portable toilet seat includes the following: a chain of arcuate portions pivotably connected in series by living hinges so as the portable toilet seat is foldable among a flat condition, a first folded condition and a second folded condition, wherein the first folded condition the portable toilet seat is folded in half, and wherein the second folded condition the portable toilet seat is folded in quarters; a plurality of radial fins provided along the bottom surface of the chain of arcuate portions, each radial fin extending radially from an inner portion of the bottom surface to an outer surface thereof; and a concentric slot formed in each of at least two of the plurality of radial fins so that in the second folded condition each concentric slot securely engages a radial fin on an opposing arcuate portion, wherein each concentric slot has a curvature, and wherein each concentric slot shares a distance to a center of a main opening defined by the flat condition.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a portable toilet seat for user over pre-existing toilet seats or in lieu of a broken or missing toilet seat. The portable toilet seat provides a chain of arcuate portions pivotably connected in series so as to be adapted to fold among a flat condition, a first folded condition and a second folded condition. The bottom side of each arcuate portions may provide radial fins, each radial fin may provide a concentric slot. The concentric slots share a radial distance from a center of the opening defined in the flat condition so that in such a condition the concentric slots may engage a rim of a toilet, while in the second folded condition the concentric slots securely engage the radial fins of opposing arcuate portions.

Referring to FIGS. 1 through 5, the present invention may include a portable toilet seat 10/30 providing a chain of arcuate portions 12/32 pivotably connected in series. The pivotable connections 14 may be living hinges so as minimize components, weight, manufacture time and cost; though in alternative embodiments the pivotable connection 14 may be other hinges or types of pivotable connection. The living hinges may have different widths, as illustrated in comparison of FIGS. 3 and 4, with FIGS. 1 and 2. Also, the living hinges may be formed into a top surface or a bottom surface of the portable toilet seat 10/30. The portable toilet seat 10/30 may be made out of various plasticized materials, and in some embodiments a plasticized film so that the portable toilet seat 10/30 would be affordably disposable after a one-time use.

Figure 1:
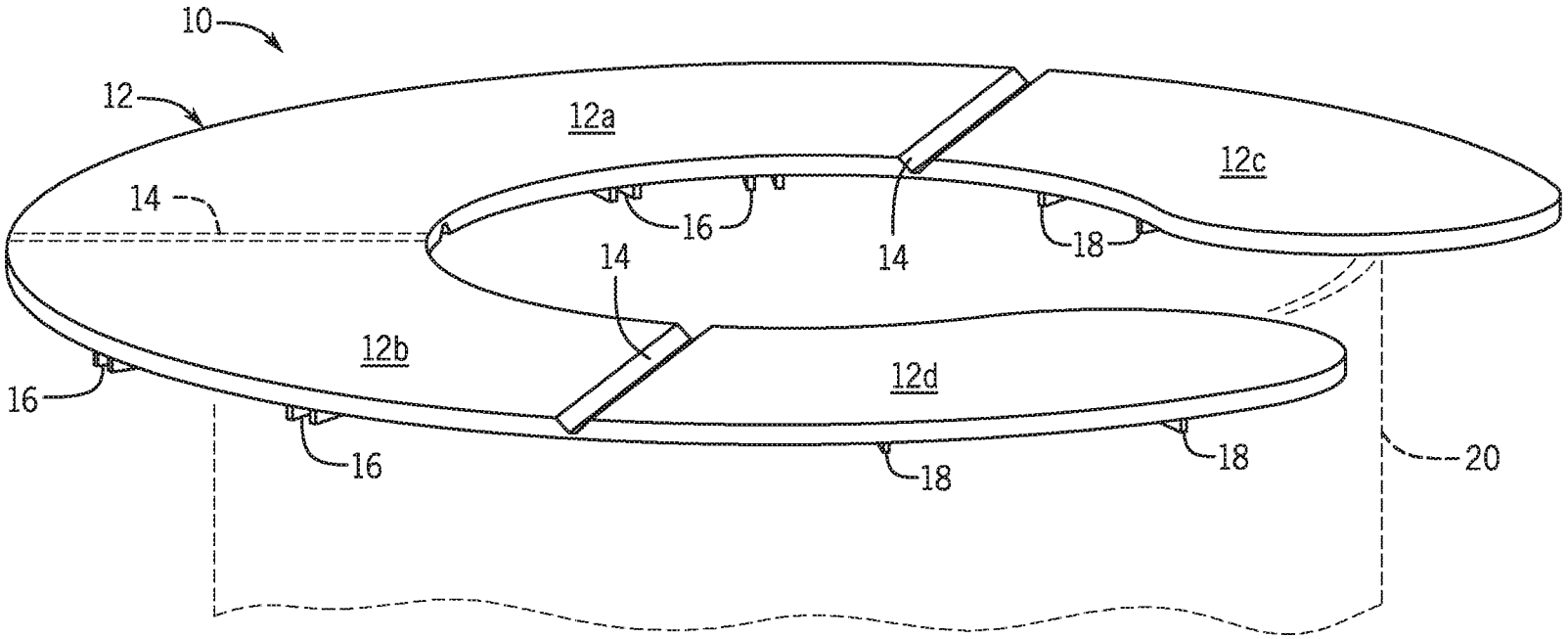
FIG. 1 is a top perspective view of an exemplary embodiment of the present invention in a flat condition in preparation of use.
Figure 3:
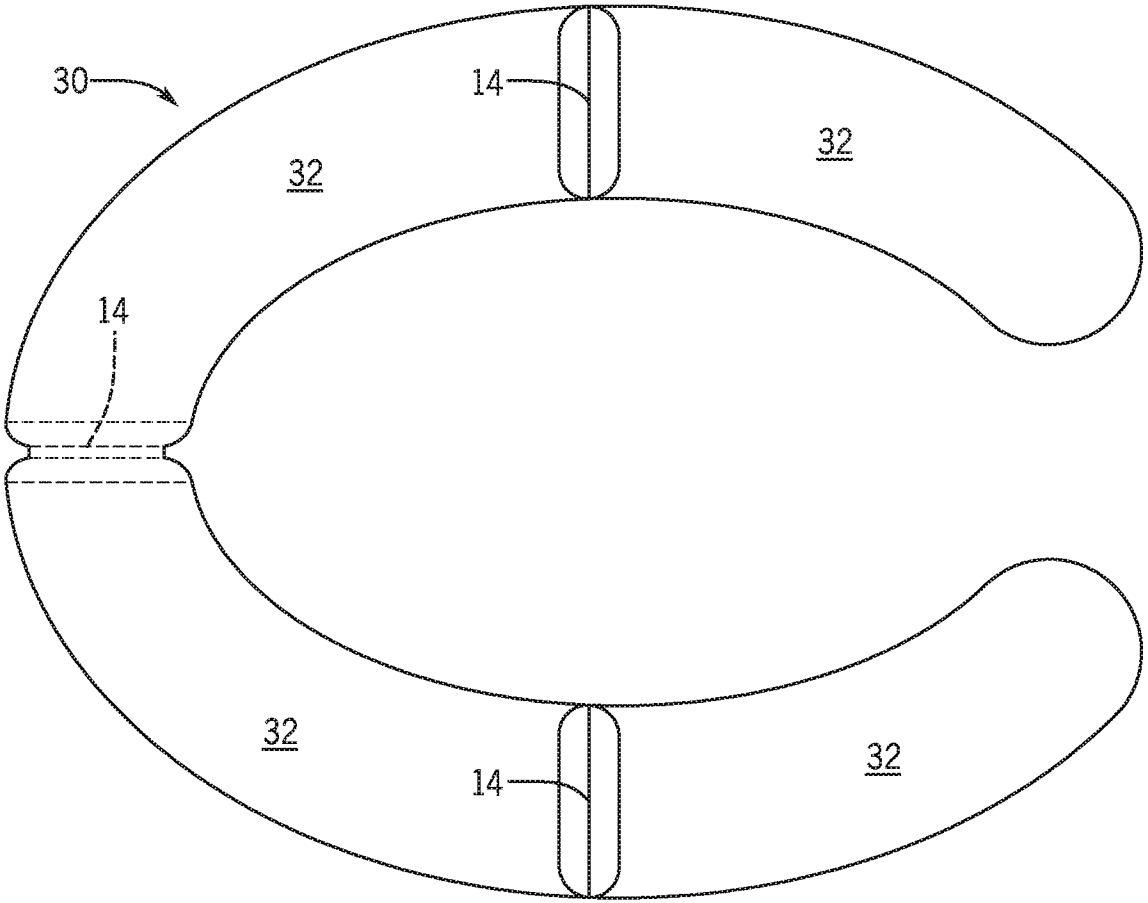
FIG. 3 is a top plan view of an exemplary embodiment of the present invention.
Figure 4:
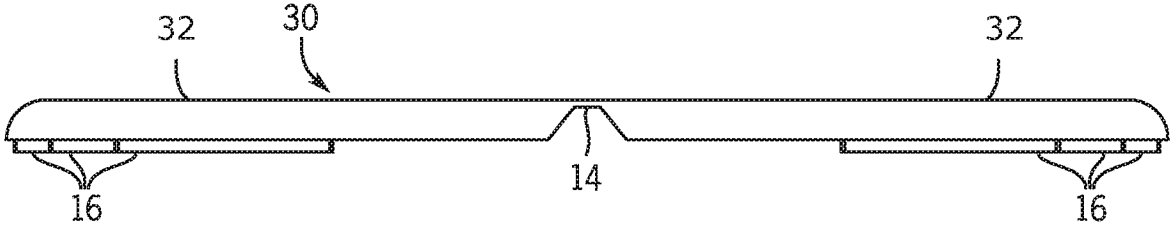
FIG. 4 is an elevation view of an exemplary embodiment of the present invention.

The arcuate portions 12 may include a first portion having a first top and an opposing bottom surface 12*a* and 12*a*', a second portion having a second top and an opposing bottom surface 12*b* and 12*b*', a third portion having a third top and an opposing bottom surface 12*c* and 12*c*', and a fourth portion having a fourth top and an opposing bottom surface 12*d* and 12*d*'. The first portion and the second portion may be mirror images of each other and associated with the rear of the portable toilet seat 10/30, while the third portion and the fourth portion may be mirror images of each other, wherein the third and fourth portions are associated with a front of the portable toilet seat 10/30, and provide a gap at their distal ends commonly found in a conventional toilet seat, as illustrated in FIGS. 1 and 3.

Figure 5:
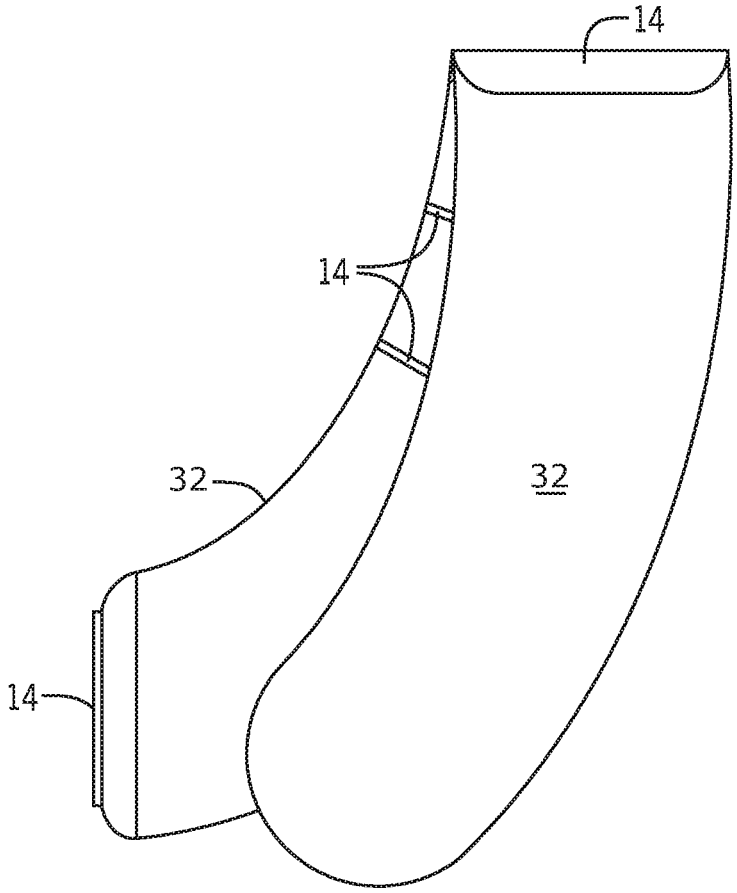
FIG. 5 is an elevation view of an exemplary embodiment of the present invention, demonstrating a first folded condition.
Figure 6:
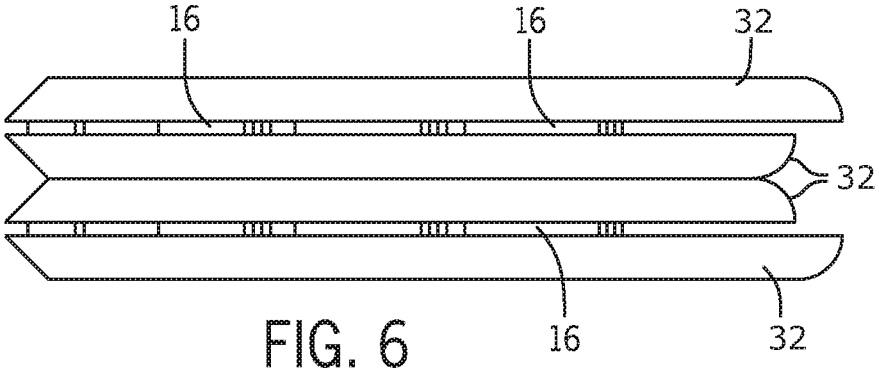
FIG. 6 is an elevation view of an exemplary embodiment of the present invention demonstrating a second folded condition.

The pivotable connections 14 enable the portable toilet seat 10/30 to be foldable among a flat condition, a first folded condition, and a second folded condition. The flat condition is for use as a toilet seat, as illustrated in FIGS. 1-4. The first folded condition may be folded in half lengthwise so that each top surface abuts an opposing top surface, as illustrated in FIG. 5. The second folded condition may be folded in quarters, as illustrated in FIG. 6. The folded conditions provide two convenient options for transport and storage, depending on the space available. For example, the second folded condition may be better suited for a backpack or purse, while the first folded condition is preferred when the height of the storage space is the critical limitation.

Figure 2:
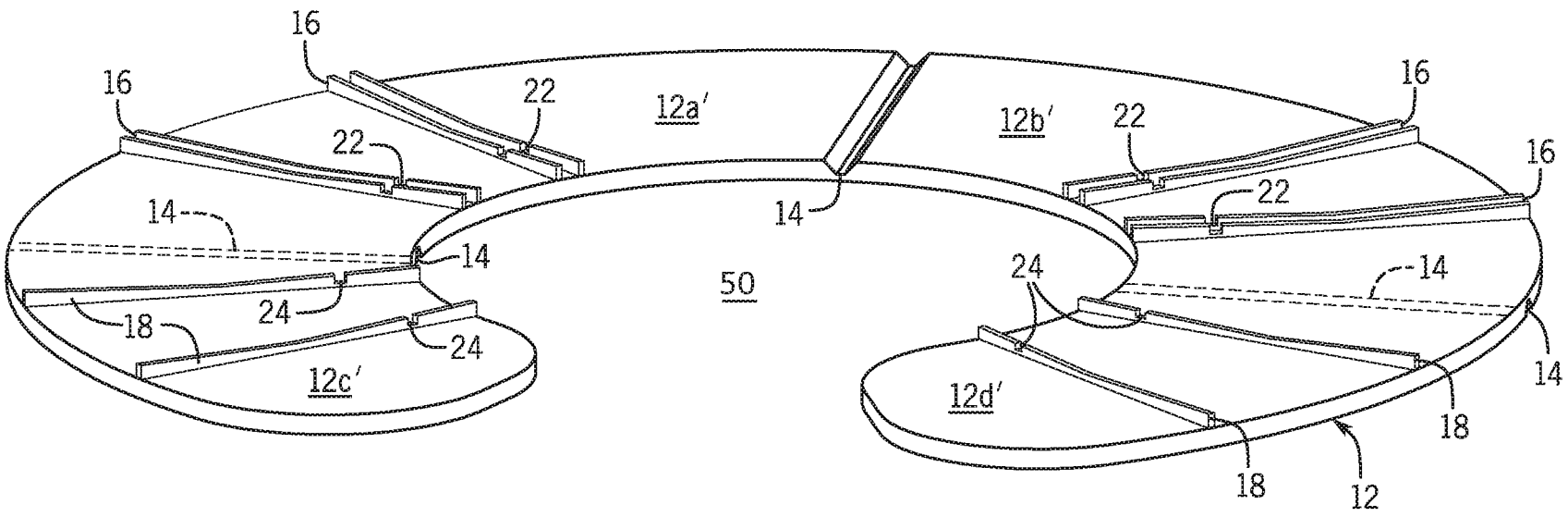
FIG. 2 is a bottom perspective view of an exemplary embodiment of the present invention.

Along the bottom surfaces 12*a*', b', c' and d' may be double radial fins 16 and/or single radial fins 18. In certain embodiments, the double radial fins 16 may be spaced apart single radial fins 16. The fins 16 and 18 are radial in that the generally extend from what would be a center of the toilet seat cover opening 50. As a result, the fins 16 and 18 extend generally transverse to each associated bottom surface, as illustrated in FIG. 2. Each fin 16 and 18 may provide a concentric slot 22 and 24 cut out of a portion of the respective fin 16 or 18 inward from the inner (nearer the toilet seat cover opening 50). Each concentric slot 22 and 24 may be concentric with each other as in the share a concentric distance from said center of the toilet seat cover opening 50. Furthermore, the concentric slots 22 and 24 may have a concentric curvature (as opposed to a perpendicular cut) through the associated fin 16 and 18. The critical aspect of the design of concentric slots 22 and 24 is that the concentric slots 22 and 24 may be dimensioned and adapted to engage a rim of a cylindrical toilet bowl, basin or bucket 20 to keep the portable toilet seat cover 10/30 secure during use, as well as to be dimensioned and adapted to engage each other in the second folded condition.

In the second folded condition, the fourth portion bottom surface 12*d*' folds back onto the second portion bottom surface 12*b*', and/or the first third bottom surface 12*c*' folds back onto the first portion bottom surface 12*a*'. In the second folded condition, the concentric slots 24 of the singular radial fins 18 would align and engage with the double radial fins 16 and/or the concentric slots 22 of the double radial fins 16 would align and engage with a single radial fin 18.

A method of using the present invention may include the following. The portable toilet seat 10/30 disclosed above may be provided. In the flat condition, a user may place the bottom surface (12*a*', b', c', d') on either a pre-existing lowered toilet seat (so as not to have to sit on it, most likely in a public restroom situation) or may place said bottom surface along the rim of a toilet bowl that has a missing or broken toilet seat. Th present invention can be used on construction sites where porta-potties are used. By a portable toilet seat 10/30 in the user's tool belt, for example, the user would be ensured of a sanitary toilet seat even if the toilet seat is missing. If the pre-existing toilet seat is missing or broken, many porta-potties "toilet basins" are cylindrical with thin sidewalls wherein the user may utilize the concentric slots 22 and/or 24 along the rim of such a cylindrical basin. Or when camping or hunting or otherwise in a pinch, the user may use a bucket by placing the portable toilet seat 10/30 along the rim 20 of the (say, five gallon) bucket so that the concentric slots 22 and/or 24 engaged said rim 20, as illustrated in FIG. 1.

After taken care of one's business, the user may fold the portable toilet seat 10/30 into the first or second folded condition for transport or storage.

It should be understood, of course, that the foregoing relates to exemplary embodiments of the invention and that modifications may be made without departing from the spirit and scope of the invention as set forth in the following claims.

What is claimed is:

1. A portable toilet seat, comprising:

a chain of arcuate portions pivotably connected in series so as the portable toilet seat is foldable among a flat condition, a first folded condition and a second folded condition;

a plurality of radial fins provided along the bottom surface of the chain of arcuate portions, each radial fin extending radially from an inner portion of the bottom surface to an outer surface thereof; and a concentric slot formed in each of at least two of the plurality of radial fins so that in the second folded condition each concentric slot securely engages a radial fin on an opposing arcuate portion.

2. The portable toilet seat of claim 1, wherein the first folded condition the portable toilet seat is folded in half.

3. The portable toilet seat of claim 1, wherein the second folded condition the portable toilet seat is folded in quarters.

4. The portable toilet seat of claim 1, wherein each concentric slot has a curvature.

5. The portable toilet seat of claim 1, wherein each concentric slot shares a distance to a center of a main opening defined by the flat condition.

6. The portable toilet seat of claim 1, wherein the pivotable connections are living hinges.

7. A portable toilet seat, comprising:

a chain of arcuate portions pivotably connected in series by living hinges so as the portable toilet seat is foldable among a flat condition, a first folded condition and a second folded condition, wherein the first folded condition the portable toilet seat is folded in half, and wherein the second folded condition the portable toilet seat is folded in quarters;

a plurality of radial fins provided along the bottom surface of the chain of arcuate portions, each radial fin extending radially from an inner portion of the bottom surface to an outer surface thereof; and a concentric slot formed in each of at least two of the plurality of radial fins so that in the second folded condition each concentric slot securely engages a radial fin on an opposing arcuate portion, wherein each concentric slot has a curvature, and wherein each concentric slot shares a distance to a center of a main opening defined by the flat condition.

* * * * *